United States Patent [19]

Pagezy et al.

[11] 4,181,452

[45] Jan. 1, 1980

[54] OIL-PRODUCTION PLATFORM AND METHOD OF ASSEMBLING AND INSTALLING THE SAME ON A SEA BED

[75] Inventors: Michel J. Pagezy; Rene Loire, both of Paris, France

[73] Assignee: Entreprise d'Equipments Mecaniques et Hydrauliques E.M.H.

[21] Appl. No.: 900,648

[22] Filed: Apr. 26, 1978

[30] Foreign Application Priority Data

May 2, 1977 [FR] France ..... 77 13159

[51] Int. Cl.[2] ..... E02B 17/08

[52] U.S. Cl. ..... 405/203; 405/205

[58] Field of Search ..... 61/90, 91, 92, 96, 94, 61/88; 114/264, 265

[56] References Cited

U.S. PATENT DOCUMENTS

| | | | |
|---|---|---|---|
| 2,946,566 | 7/1960 | Samuelson | 61/96 X |
| 3,385,069 | 5/1968 | Estes | 61/90 |
| 3,433,024 | 3/1969 | Diamond et al. | 61/90 |
| 3,927,535 | 12/1975 | Giblon | 61/90 |
| 4,073,155 | 2/1978 | Schiemichen | 61/90 X |

FOREIGN PATENT DOCUMENTS

| | | | |
|---|---|---|---|
| 991247 | 5/1965 | United Kingdom | 405/207 |
| 1220689 | 1/1971 | United Kingdom | 405/204 |

*Primary Examiner*—Dennis L. Taylor

*Attorney, Agent, or Firm*—Steinberg and Blake

[57] ABSTRACT

The invention relates to a method of assembling and installing a device for exploiting an oil-field. Said device comprises an upper structure comprising two superposed platforms provided with a vertically slidable column, and a lower structure comprising at least two tanks connected to the upper structure by means of support legs. Such a device allows its elements i.e. each of the platforms and the tanks to be fabricated separately, and the assembly to be performed only in floating conditions and not in a dry dock. Furthermore the fabrication can therefore take place in a yard designed for constructions of small size compared with that of the completely assembled device.

8 Claims, 11 Drawing Figures

Figure 1:
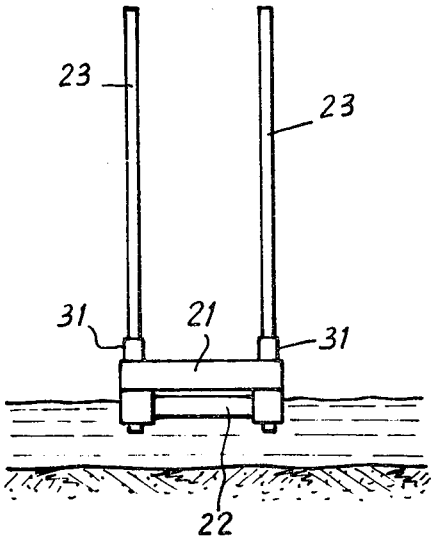

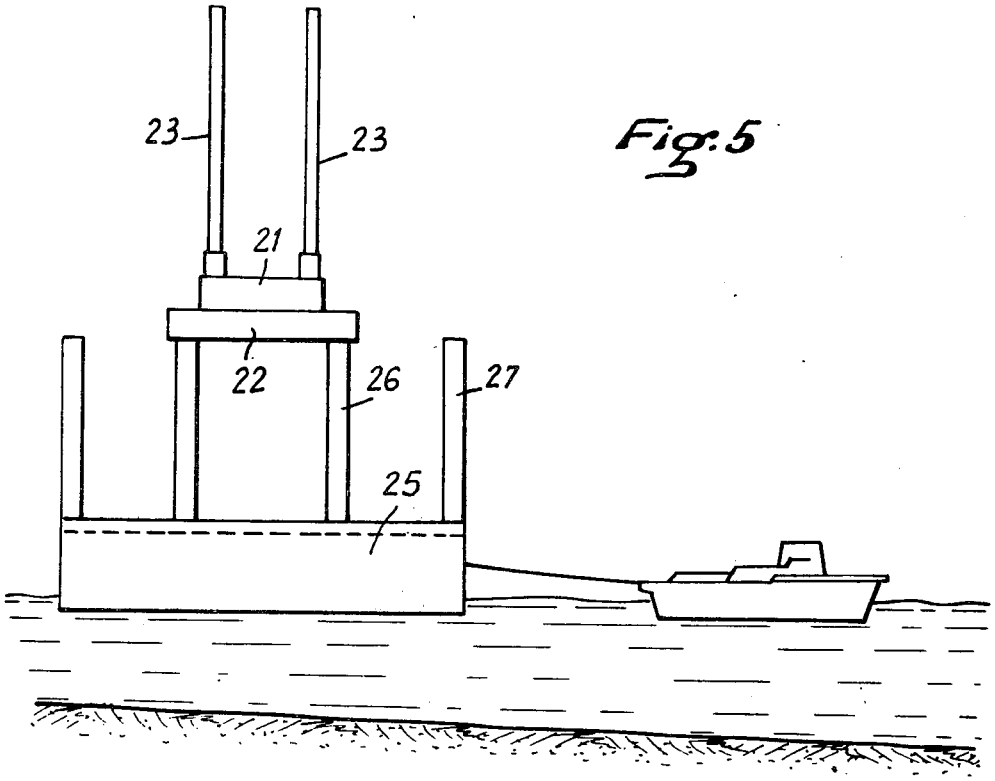
Fig. 5
Fig. 6
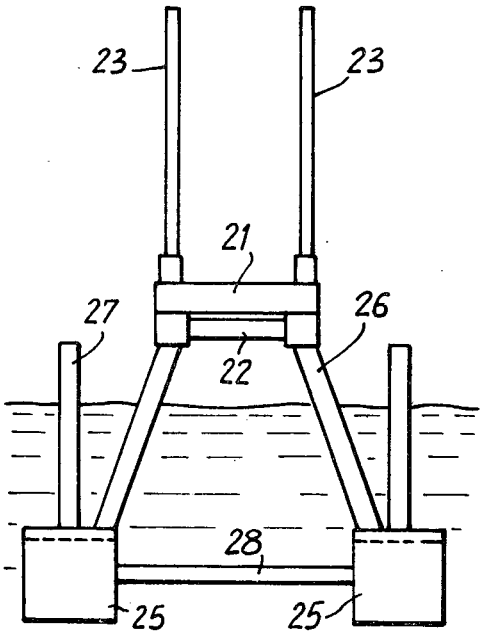
Fig. 7
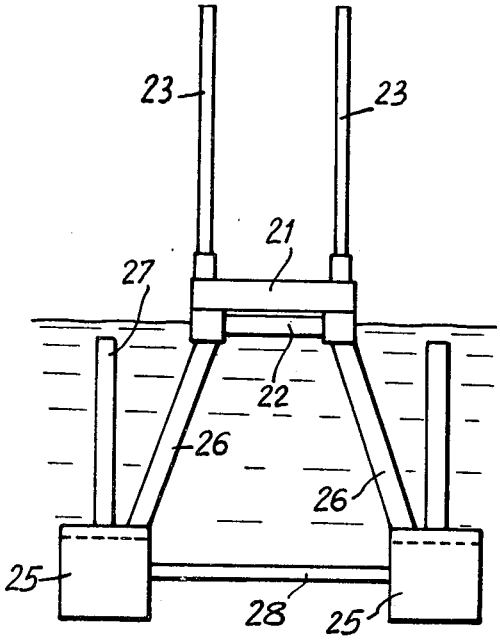

OIL-PRODUCTION PLATFORM AND METHOD OF ASSEMBLING AND INSTALLING THE SAME ON A SEA BED

The present invention relates to a production device for the exploitation of underwater oil-fields. Different types of devices of that kind, usually known as platforms, have been developed, which in fact comprise at least one platform and a structure serving to maintain the platform at a certain height above sea level. The invention relates to a device of that kind, of the type bearing upon the sea bed or ocean floor.

The construction and installation of such devices present problems that are very difficult to solve. Such structures being of very large dimensions, they can be constructed only in very large yards, and their haulage to the exploitation site as well as their submersion are long and delicate operations.

The invention has for its object to provide a platform of that type and a method of installing such a platform, allowing its construction and transportation to the site to be greatly simplified.

According to the present invention, the device comprises an upper structure including an upper platform and a lower platform superposable on one another and of substantially the same dimensions, each comprising at least three aligned openings for the passage of vertical columns, means for either displacing and securing the columns in the said openings in any relative position with respect to each of the platforms, and a lower structure comprising two tanks of elongated shape, means for maintaining the tanks parallel to one another with a certain spacing therebetween, and means for supporting the upper structure to a certain height above the tanks.

The invention also has for its object to provide a method of installing such a device. Such a structure allows its elements, i.e. each of the platforms and the tanks, to be fabricated separately, and the assembly to be performed only in floating conditions and not in a dry dock. The fabrication can therefore take place in a yard designed for constructions of small size compared with that of the completely assembled device.

The procedure according to the invention is as follows. The upper structure comprising the two superposed platforms provided with vertically slidable columns is taken to a shallow-water site; the platforms are raised, by means of fluid-operated actuators, along the columns bearing upon the sea bed; the tanks preferably weighted and ballasted are installed under the platforms and the tanks are assembled to one another and to the lower platform to thus provide the lower structure; the whose assembly constituting the device is hauled to the utilization site; the tanks are lowered into the water by being ballasted until the platforms are floating; the columns being in raised position with respect to the platforms, the lowering of the tanks is continued using the upper platform as a float, causing it to rise with respect to the columns; the tanks contact the sea bed and the upper platform is raised to the desired level above water; the elements are fastened to one another, e.g. by welding, and then the accessory members such as the fluid-operated actuators are removed.

Figure 9:
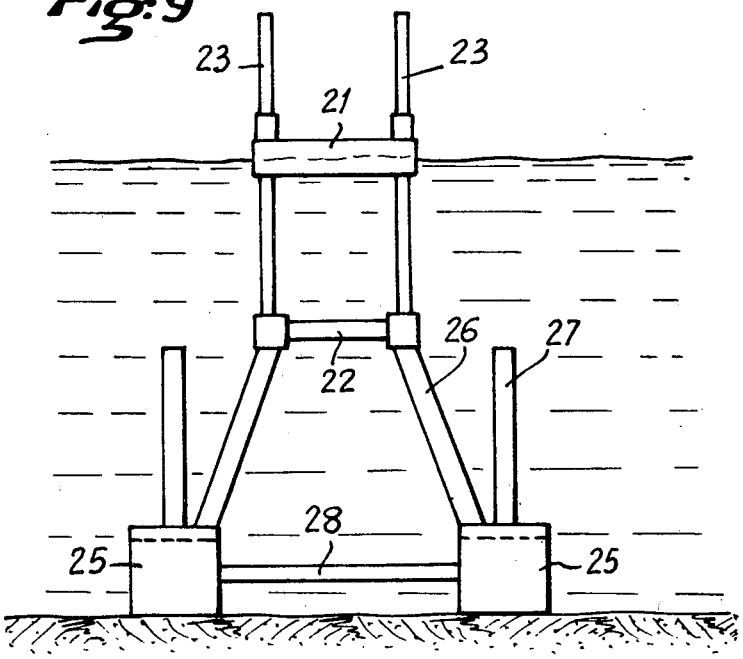
Figure 10:
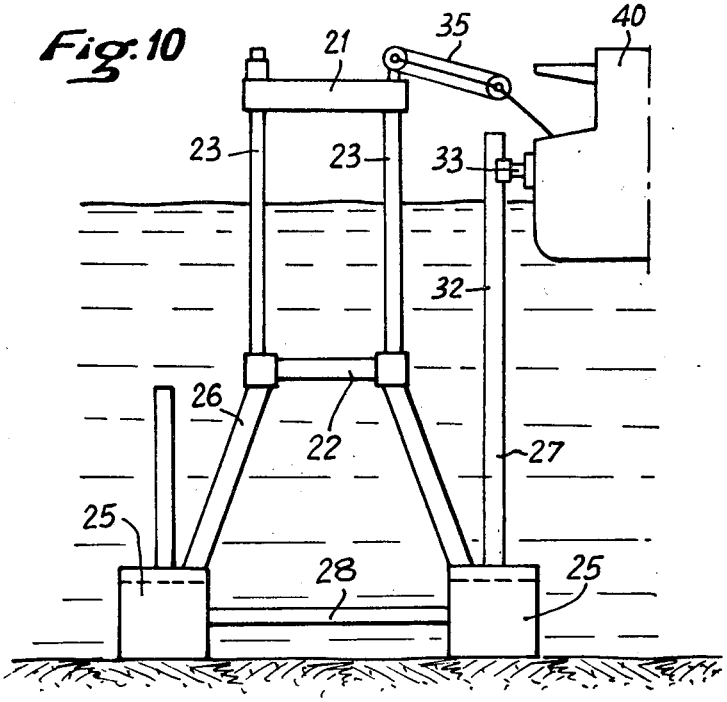
Figure 11:
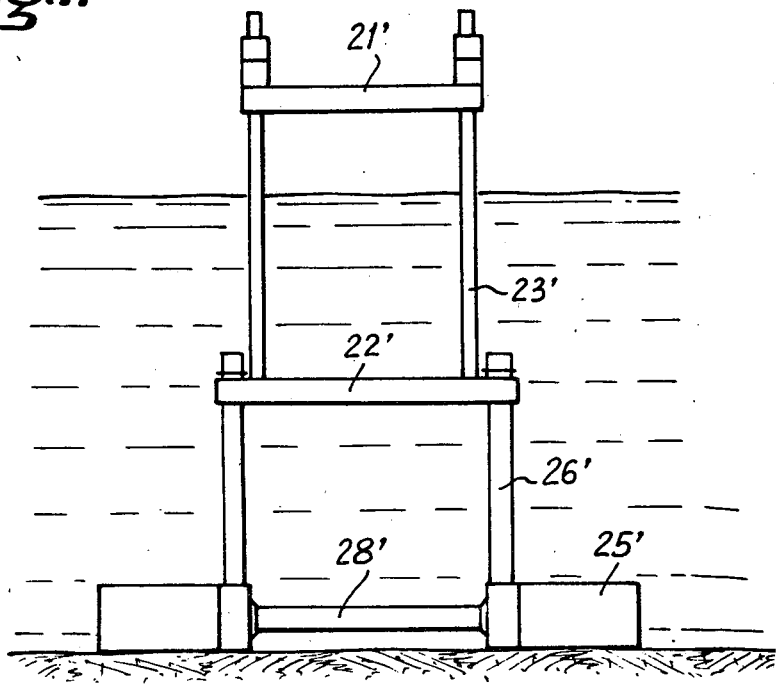

The invention will be better understood and other purposes, characterizing features, details and advantages of the latter will appear more clearly from the following explanatory description with reference to the appended diagrammatic drawings given solely by way of example illustrating different forms of embodiment of the invention and wherein:

FIGS. 1 to 10 are diagrammatic views illustrating the various stages of assembly, transportation and installation of a device according to the invention, and FIG. 11 is a diagrammatic view illustrating an alternative embodiment in exploitation condition.

Referring to FIGS. 1 to 10, the device comprises an upper structure and a lower structure. The upper structure comprises an upper platform 21, a lower platform 22 which may be a wind-bracing frame, and four columns 23, only three of which are seen in the drawings and the number of which may vary according to the size of the device. At least three of them are used, the usual number being from four to six. Such an assembly is already known and has been used successfully. The platforms are provided with aligned openings through which the columns 23 are passed. Means are provided to allow the platforms to be displaced either together or separately along the columns. As a rule, use is made of compressed- air actuators which can be removed when the device is completely installed. The columns instead of passing through the platforms can be placed externally against one edge of the platforms and have any desired section. In a typical case of application, the columns may be 1.80 m in diameter.

Figure 2:
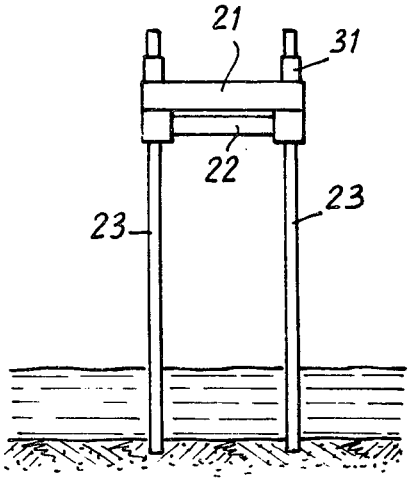

FIGS. 1 and 2 illustrate the use of such upper structure. The platforms are displaced by being hauled in the condition represented in FIG. 1, i.e. with the two platforms against one another at the lower end of the columns. Such a structure can therefore be readily taken to a shallow-water place, e.g. from 6 to 10 meters in depth, in a harbour basin, a place that is suitable for assembling the device according to the invention. At 31 are shown the actuators for relative movement of the columns with respect to the platforms. Such actuators may be for example of the type known as "Delong hoists", an equipment that has stood the test of experience. Only the upper platform needs to be equipped with such actuators, the movement of the lower platform being obtained by providing a temporary connection between the two platforms. As will be seen later, all operations can be carried out quite simply under such conditions.

The lower structure comprises two tanks 25 which serve successively as floats, as a seating base for the device and as oil tanks. The lower structure is completed with support legs 26 installed and rigidly fastened at the yard on the tanks. There are also advantageously provided balancing pipes 27 consisting of large hollow cylinders allowing the lowering of the tanks during the submersion to be controlled. Such a balancing pipe participates in the lowering process through its known displacement and may be weighted to displace the equilibrium through partial filling with water. Also, the said balancing pipes may be extended in length so as to be used as mooring posts as shown in FIG. 10. The lower structure is completed with a hollow cross-member or cross-brace 28 for maintaining the spacing between the tanks 25 and at the same time providing a communication between the tanks. It is of course understood that the lower structure may comprise a greater number of tanks than two, but the structure with two tanks is of particular interest from the point of view of its assembling, hauling to the exploitation site as well as stability in use. The lower platform 22 interconnects the two structures and participates in both structures.

A device thus constituted is assembled and installed in the following manner. The upper platform 21 and the lower platform 22 are taken to a sheltered, shallow-water basin, with the columns already put in place. The platforms are superposed against one another and the columns are maintained by the hoists in upper position, thus allowing displacement in shallow water. The grip of the hoists is then relaxed and the columns fall onto the basin bottom.

Figure 3:
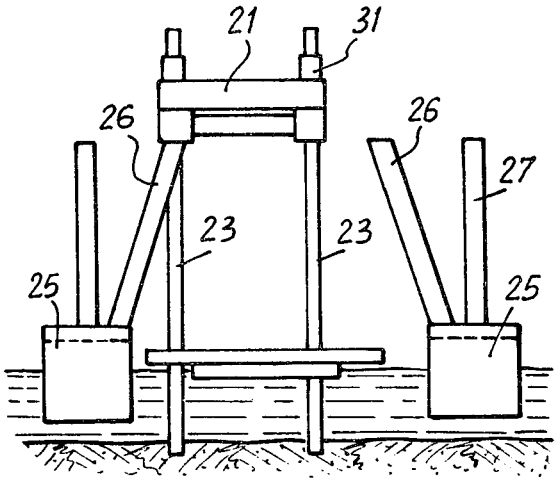
Figure 4:
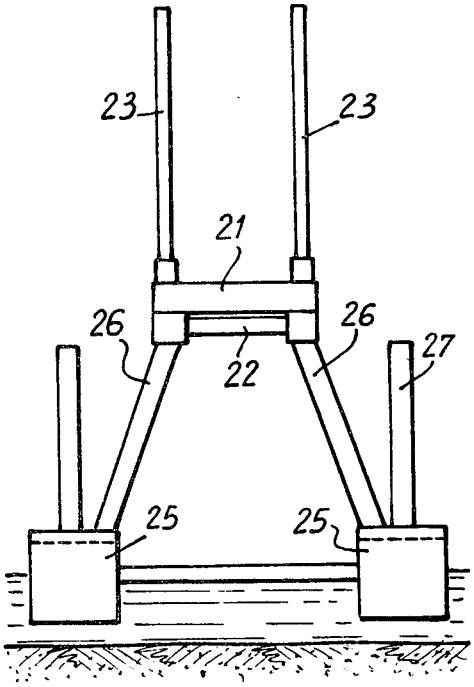

The platforms are thereafter (FIG. 2) jointly self-elevated to a level allowing the following operation to be carried out. During this operation the lower platform may be temporarily suspended from the upper platform. The float tanks 25 provided with the support legs 26 and preferably with the balancing pipes 27 are moved to floating position (FIG. 3). To do this, the tanks are weighted and ballasted. They include to this end ballast spaces or sections designed to withstand the highest pressures in use, for example at the depth of 75 m or more, without collapsing. The tanks may also include sections adapted to remain in pressure equilibrium (equipressure) with the exterior. The height of columns 23 is therefore so selected, depending on the depth of the basin and on the height of the support legs 26, that the top of the legs 26 be placed under the lower platform 22. After adjusting the levels the legs 26 are welded to the platform 22, then the cross-members or cross-braces 28 are placed between the tanks. The columns 23 are raised so as to be disengaged from the sea bottom to allow the now completed device to be displaced. As appears in FIG. 4, they can be moved to their final positions and welded to the platform 22, thus restricting the operations to be carried out at the exploitation site. The tanks are then at least partially deballasted and the device can be hauled to the site of exploitation. The device behaves as a catamaran, so that its stability is good and the hauling force is reduced (FIG. 5).

On arriving at the site or in proximity thereto, the tanks are first completely submerged (FIG. 6) by actuating bottom valves, thus causing both platforms, still joined together, to be brought to water level to serve as floats (FIG. 7). In order that the tanks can be completely filled with water the moment they begin to disappear under the sea and the risks of implosion to be obviated, level raising means are advantageously placed at their top, defining a volume the displacement of which is equivalent to the own weight of the structure and ballast. The level raising means are not overpassed by the sea until the tanks are full. At that instant the structure rapidly sinks in vertical position while a certain braking action is ensured by the legs 26 which may be, for example, 3.50 m in diameter and are kept empty of water, and by the auxiliary balancing pipes 27 secured at the ends of the tanks and which also act as stabilizers.

The hollow cross-members placed between the tanks allow them to communicate with one another and assist in maintaining the horizontality of the whole assembly during their filling.

Figure 8:
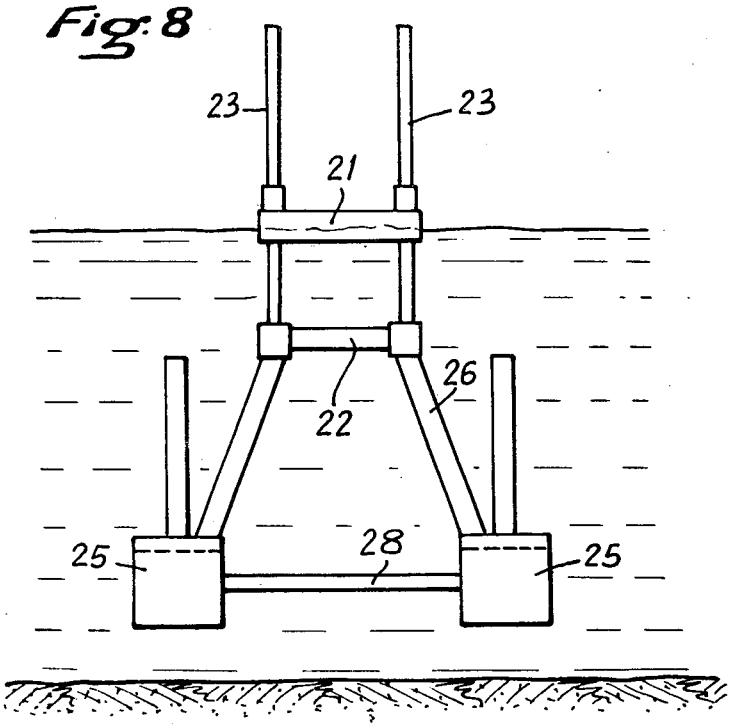

The lowering is then continued by means of the air-operated actuators, submerging the lower platform 22 and using the floatation of the upper platform 21 to maintain equilibrium (FIG. 8). The base tanks 25 contact the sea bed under the control of the actuators, therefore under favourable conditions to avoid shocks (FIG. 9). The self-elevation of the platform 21 is continued, e.g. to a height of the order of 20 m above sea level (FIG. 10).

After the self-elevation of the platform, the columns of the upper level are welded to the hull constituting the platform, according to the conventional process applied in connection with self-elevating platforms. The actuators may then be withdrawn. The portions of the columns overtopping the deck are cut down to the level of the latter unless a displacement of the structure in the near future is anticipated.

It is to be noted that the self-elevation allows any possible lack of horizontality of the foundation to be corrected to a certain extent.

The balancing pipes 27 may be removed if suitable, or they may be used as mooring posts (FIG. 10) by adding an upward extension 32 provided with an appropriate fender 33. FIG. 10 diagrammatically shows a tanker 40 being loaded by means of an arm 35.

One of the advantages of the device according to the invention is that it can be displaced subsequently, for example if the oil-field should not come up to expectations.

Should such a displacement be necessary, the actuators are reinstalled and a process reverse to that of installation is carried out. The tanks are lightened by means of compressed air to make them raisable by the actuators. Another method consists in keeping them full of oil and using the upward thrust thereof. It should be noted, however, that it is possible to keep to the configuration shown in FIG. 7 in moving to another site of production if it is rather near.

Should the depth of the other oil-field be greater, the upper platform may be raised accordingly with respect to its first position while at the same time remaining stable. Of course the structure may also be installed on sea beds less than 75 m deep.

Obviously, the reinstallation of the platform according to the invention is much easier than if the structure were anchored by means of piles deeply driven into the sea bed, which besides would not be easy to cut, since it would not be possible to pull them out without damaging the structure.

In case sea bed scouring by underwater currents is to be feared, reliable protection can be obtained by using mats of plastics material laid on the sea bed about the tanks.

During exploitation, the tanks are used as storage containers, allowing tankers to be loaded under favourable conditions without interrupting the exploitation.

The width of both platforms as well as the tanks is such that they can be fabricated in a dry dock or a graving dock for relatively small-tonnage ships, e.g. of the cargo type.

The upper platform receives its functional equipment beforehand so as to avoid hazardous handling at sea by means of heavy floating contrivances. The installation of such equipment is therefore performed at the shipyard, on a land area or platform thereof.

The haulage of the above-mentioned catamaran arrangement (FIG. 5) may be effected with a reduced draft, of the order of 4.50 m, allowing rapid conveyance at a speed of at least 100 miles per day.

FIG. 11 represents an alternative embodiment in which the elements corresponding to those of the first form of embodiment are designated by the same reference numerals associated with the sign prime. In this modified embodiment the support legs 26' are vertical and constitute lower columns. The lower platform 22' is provided with openings for the passage of the lower columns 26' and with other openings for the passage of the upper columns 23', so that it is displaceable with respect to the upper or the lower columns. It may be mounted on the lower columns by being temporarily hooked or attached to the upper platform 21' and by lowering the upper columns 23' which, by bearing on the bottom, raise both platforms.

The structure according to the invention may be commonly used in waters at least about 75 m deep. It can be constructed rapidly in a shipyard equipped with small docks. The structure is selfstable, simply resting on the sea bed without requiring the use of driven-in foundation piles. The conveyance to the site entails only easy haulage and does not require great water depth. The installation does not require the use of heavy floating lifting means.

Of course the invention is by no means limited to the forms of embodiment described and illustrated which have been given by way of example only. In particular, it comprises all technical means equivalent to the means described as well as their combinations should the latter be carried out according to its gist and used within the scope of the following claims.

What is claimed is:

1. A device for exploiting an oil-field, e.g. an underwater oil-field, wherein said device comprises an upper structure constituted by an upper exploitation platform and a lower wind-bracing platform, the said platforms being traversed by at least three columns, means for displacing and securing the columns at any relative position with respect to each platform, and a lower bearing structure adapted to rest upon the sea bed comprising a base constituted by two tanks of elongated shape, means for maintaining the tanks parallel to one another and at a certain distance from one another, and means for supporting the upper structure at a certain height above the tanks, said upper structure supporting means including support legs, each of said support legs being connected at one end region to a respective one of said tanks and at its other end region to said lower platform, said support legs being inclined with respect to the axes of said columns in a manner such that said tanks are located outside the contour of the vertical projection of said lower platform.

2. A device according to claim 1, wherein the said tanks are provided with substantially vertical balancing pipes for controlling the lowering of the tanks into the water.

3. A device according to claim 2, wherein at least one of the said balancing pipes is extended in length above sea level to form a mooring post.

4. A device according to claim 1, wherein the said means for maintaining the tanks parallel to one another and at a certain distance from one another are constituted by cross-members or cross-braces.

5. A device according to claim 4, wherein the said cross-members or cross-braces are hollow to provide a communication for fluid between the said tanks.

6. A device according to claim 1, wherein the said means for displacing or securing the columns are constituted for example by pneumatic or air-operated elevating or lifting means.

7. A method of assembling and installing a device for exploiting an oil-field, for example an underwater oil-field, comprising an upper structure constituted for example by two superposed platforms and a lower supporting structure bearing on the sea bed or ocean floor, comprising the steps of:

transferring to a shallow-water site the said upper structure with its upper platform and its lower platform superposed on one another and equipped with columns slidingly passing through the said platforms, raising the said platforms of the upper structure along the said columns while the latter are bearing upon the sea bed, transferring to the said shallow-water site float tanks preferably weighted and ballasted, connecting the said tanks to one another and to the lower platform of the upper structure by support legs previously attached to the tanks to obtain the said lower structure of the exploitation device, hauling the thus assembled exploitation device to the exploitation site after modifying, if necessary, the ballasting of the float tanks, after reaching the exploitation site, submerging the said tanks by ballasting the same until the platforms of the upper structure are brought to floating position, continuing the submersion of the said tanks, using the upper platform of the upper structure as a float while at the same time causing it to rise with respect to the said column, and causing the said upper platform to rise to the desired level above water level once the said tanks are completely sunk and are bearing upon the sea bed.

8. A device for exploiting an oil-field, e.g. an underwater oil-field, wherein said device comprises an upper structure constituted by an upper exploitation platform and a lower wind-bracing platform, the said platforms being traversed by at least three columns, means for displacing and securing the columns at any relative position with respect to each platform, and a lower bearing structure adapted to rest upon the sea bed comprising a base constituted by two tanks of elongated shape, means for maintaining the tanks parallel to one another and at a certain distance from one another, and means for supporting the upper structure at a certain height above the tanks, said upper structure supporting means including support legs, each of said support legs being connected at one end region to a respective one of said tanks and at its other end region to said lower platform, said support legs comprising vertical posts constituting second columns with respect to which said upper structure is displaceable.

* * * * *